US005123433A

United States Patent [19]

Fridsma et al.

[11] Patent Number: 5,123,433

[45] Date of Patent: Jun. 23, 1992

[54] ULTRASONIC FLOW NOZZLE CLEANING APPARATUS

[75] Inventors: Daniel E. Fridsma, Winter Springs; George J. Silvestri, Jr., Winter Park; Michael Twerdochlib, Oviedo, all of Fla.

[73] Assignee: Westinghouse Electric Corp., Pittsburgh, Pa.

[21] Appl. No.: 356,162

[22] Filed: May 24, 1989

[51] Int. Cl.[5] ..... B08B 3/10

[52] U.S. Cl. ..... 134/104.1; 134/166 C; 134/184; 239/106

[58] Field of Search ..... 134/184, 166 R, 104.1, 134/166 C; 237/102.2, 106; 366/127; 261/DIG. 34; 68/3 SS

[56] References Cited

U.S. PATENT DOCUMENTS

| | | | |
|---|---|---|---|
| 2,578,505 | 11/1951 | Carlin | 366/127 X |
| 2,980,123 | 4/1961 | Lemelson | 134/184 |
| 3,198,489 | 8/1965 | Finch | 259/2 |
| 3,601,084 | 8/1971 | Biro et al. | 116/137 A |
| 3,691,824 | 9/1972 | Vanderbilt, Jr. et al. | 73/118.1 |
| 3,700,169 | 10/1972 | Naydan et al. | 239/102.2 |
| 3,870,972 | 3/1975 | Vanderbilt, Jr. et al. | 331/140 |
| 4,082,565 | 4/1978 | Sjolander | 134/184 |
| 4,320,528 | 3/1982 | Scharton et al. | 376/310 |
| 4,326,553 | 4/1982 | Hall | 134/184 |
| 4,433,916 | 2/1984 | Hall | 366/127 |
| 4,691,724 | 9/1987 | Garcia et al. | 134/1 X |
| 4,762,668 | 8/1988 | Loose et al. | 376/310 |
| 4,809,547 | 3/1989 | Warrow | 73/183 |
| 4,856,344 | 8/1989 | Hunt | 73/861.04 |
| 4,895,603 | 1/1990 | Semp et al. . | |

FOREIGN PATENT DOCUMENTS 3046061 6/1982 Fed. Rep. of Germany .

*Primary Examiner*—Frankie L. Stinson

[57] ABSTRACT

An ultrasonic cleaning apparatus and method is provided for a venturi flow nozzle which is mounted in a pipe having fluid flowing therethrough. The apparatus includes a plurality of ultrasonic transducers mounted in openings provided upstream of the venturi flow nozzle inlet. The transducers transmit ultrasonic waves directly into and thereby excite the fluid flowing through the venturi flow nozzle and create cavitation which cleans the nozzle. Additional transducers are preferably provided in the throat area of the venturi flow nozzle. In alternative embodiments, the transducers are mounted in high and low pressure taps associated with the venturi flow nozzle such that the transducers directly transmit ultrasonic waves into fluid flowing into the high and low pressure taps. The transducers may be mounted flush with the interior of the pipe or venturi flow nozzle, or the transducers may be mounted at a position spaced therefrom in the high and low pressure tap piping.

16 Claims, 3 Drawing Sheets

ULTRASONIC FLOW NOZZLE CLEANING APPARATUS

BACKGROUND OF THE INVENTION

1. Field of the Invention

The present invention relates generally to ultrasonic cleaning, and more specifically, to a method and apparatus for cleaning deposits from flow nozzles or venturis by causing ultrasonic cavitation in a fluid flowing therethrough.

2. Description of the Related Art

Nuclear power plants usually operate at the full thermal power for which they are licensed. The percent of thermal power at which the unit is operating is determined by the final feed water flow times the enthalpy difference between the steam generator output and inlet times a conversion factor times 100 divided by the licensed power. The resulting value may not exceed 100%. The closer to 100% thermal power the unit operates, the more megawatts are produced by the generator which are available to the utility's customers. Anything which limits achieving 100% thermal power results in increased costs for the utility because the missing megawatts must be replaced either by increasing the megawatts produced by one of their higher-operating-priced fossil units, or by purchasing the megawatts from another utility at a premium. For example, the losses associated with operating a 1,000 megawatt nuclear unit at 98% thermal power instead of 100% will be approximately 20 megawatts. This translates into an extra cost to the utility of as such as $10,000 per day to replace the megawatts with another unit, or a minimum of $30,000 per day to purchase replacement megawatt-hours.

A common cause of low thermal power is fouling of the feedwater flow nozzles or venturis. This has been a troublesome problem to the nuclear power industry. The nozzles or venturis which operate based on the Bernoulli flow theorem are used to measure the feedwater flow. Water flowing in the nozzle or venturis is accelerated through a reduction in area, and the increase in water velocity causes a corresponding decrease in pressure. The flow is proportional to the difference in pressure measured at the inlet to the nozzle (the large area) and the pressure measured at the throat of the nozzle (the small area). As the nozzle fouls, deposits adhere to the surface of the nozzle, thus decreasing the throat area. The true flow (which remains unchanged) is now being forced through a greater reduction in area, and this results in a greater difference in pressure. The higher pressure differential causes a higher flow to be calculated. This higher calculated flow is fictitious because of the effect of the deposits. The real flow remains the same. When the calculated feedwater flow rate is used in the thermal power equation, it results in a fictitiously high thermal power calculation. As the nozzles foul, the utility makes adjustments to maintain full thermal power. The utility is led to believe that the unit is operating at 100% thermal power when in reality it is not. The outcome is that the unit is producing fewer megawatts than it could, and the utility ends up paying additional cost to replace the missing megawatts.

Feedwater nozzle fouling can be reduced by paying close attention to steam/water chemical purity in the power plant, and by eliminating known sources of deposits (such as, copper tubes in heaters or condensers). Not every chemical upset can be prevented, however, and tube replacement is an expensive solution which requires an outage. Even so, fouling cannot be totally prevented.

Other means to circumvent this problem have been developed. One such development is the use of a port in the nozzle assembly through which a water jet can be inserted to wash away the deposits. This solution, however, requires an outage. Another development is the use of a type of flow measuring device which is not effected by deposits, such as the leading edge flowmeter which is based on the Doppler Effect. However, this device is expensive and requires special maintenance.

Ultrasonic cleaning systems have been developed in recent years. Ultrasonic cleaning is a non-destructive method which uses sound waves to cause cavitation in a liquid. Cavitation is the formation and implosion of tiny vapor pockets which release energy in the form of instantaneous high pressures and temperatures. The cavitation creates a scrubbing action which loosens and removes contaminants while leaving the surface entirely unaffected.

A device which uses ultrasonic transducers to clean deposits from flow, nozzles is described in U.S. Pat. No. 4,762,668, issued on Aug. 9, 1988. The patent describes an ultrasonic cleaning device for a venturi flow nozzle mounted in a pipe in a fluid system in which a transducer is mounted adjacent the pipe for the purpose of producing sound waves. A rod is connected at one end to the transducer and extends through an opening into the pipe so that the other end of the rod contacts the nozzle to transmit the sound waves to the nozzle. A guiding and sealing assembly is also provided for the rod for attachment to the pipe around the pipe opening. In operation, the cleaning device is mounted to a pipe and venturi nozzle, or each transducer assembly is supported solely by each guiding and sealing assembly. Power is supplied to the transducers by any suitable source through electrical connections. During use, an automatic timer is employed to actuate the transducers as desired. The sound waves generated by the transducers prevent fouling in the venturi flow nozzle by preventing deposits from building up. The sound waves, which create ultrasonic cavitation, are designed to excite the nozzle directly.

A continuing need exist for improved methods and apparatuses which are capable of easily cleaning venturi flow nozzles, and which are relatively inexpensive and easy to install and which do not require plant shut down and pipe drainage to implement.

SUMMARY OF THE INVENTION

An object of the present invention is to provide an ultrasonic cleaning device for venturi flow nozzles which can be operated on-line and does not require plant shutdown.

Another object of the present invention is to provide an ultrasonic device for cleaning fluid conduits, especially venturi flow nozzles, which is automatic in operation and therefore does not have to be operated manually.

Another object of the present invention is to provide an ultrasonic cleaning device for fluid conduits, especially venturi flow nozzles, which is relatively inexpensive, easy to install, and is essentially maintenance free.

In a preferred embodiment, an ultrasonic cleaning apparatus for a venturi flow nozzle having an inlet, venturi throat, and an outlet and being mounted in a pipe having fluid flowing therethrough includes first ultrasonic transducer means disposed in the fluid flowing through said venturi flow nozzle for transmitting ultrasonic waves directly into and thereby exciting the fluid flowing through the venturi flow nozzle, and control means coupled to the first ultrasonic transducer means for activating the first ultrasonic transducer means.

Preferably, the pipe is provided with a plurality of first openings which are equidistantly and radially spaced in proximity to and upstream of the inlet of the venturi flow nozzle. A plurality of first housings are disposed in the plurality of first openings such that a head portion of each housing is in communication with the fluid flowing through the pipe. The first transducer means includes a plurality of first transducers, each being mounted in the head portion of a corresponding housing.

Second transducer means may be provided in openings formed in the venturi throat of the venturi flow nozzle. A plurality of second housings are fitted into the openings and receive a plurality of second transducers. The second transducers are also controlled by the control means.

The first and second transducers may optionally be mounted, with or without separate housings, in high and low pressure taps which are used to supply pressure readings to a change in pressure ($\Delta P$) transmitter. When using the pressure taps, the plurality of first and second transducers may be mounted flush with the interior of the venturi flow nozzle, or they may be mounted in the pressure tap piping spaced from the venturi flow nozzle. When spaced from the nozzle, the transducers transmit ultrasonic waves through fluid in the pressure tap piping.

Another aspect of the present invention is an ultrasonic cleaning method which includes the steps of installing ultrasonic transducers in direct contract with the fluid flowing through the pipe at the venturi flow nozzle and activating the ultrasonic transducers to send ultrasonic vibrations which cause cavitation in the fluid.

The method may include monitoring one of a plurality of operational parameters of a power system, computing a ratio of the monitored operational parameter to a baseline operational parameter which is predetermined by testing a fully cleaned venturi flow nozzle, comparing the computed ratio to a reference ratio predetermined to be slightly less than 1.00, and activating the ultrasonic transducers when the computed ratio is less than the reference ratio. The reference ratio is preferably about 0.995.

These, together with other objects and advantages, which subsequently will be apparent, reside in the details of construction and operation of the invention as more fully hereinafter described and claimed, reference being made to the accompanying drawings forming a part hereof wherein like numerals refer to like parts throughout.

DETAILED DESCRIPTION OF THE PREFERRED EMBODIMENTS

Figure 1:
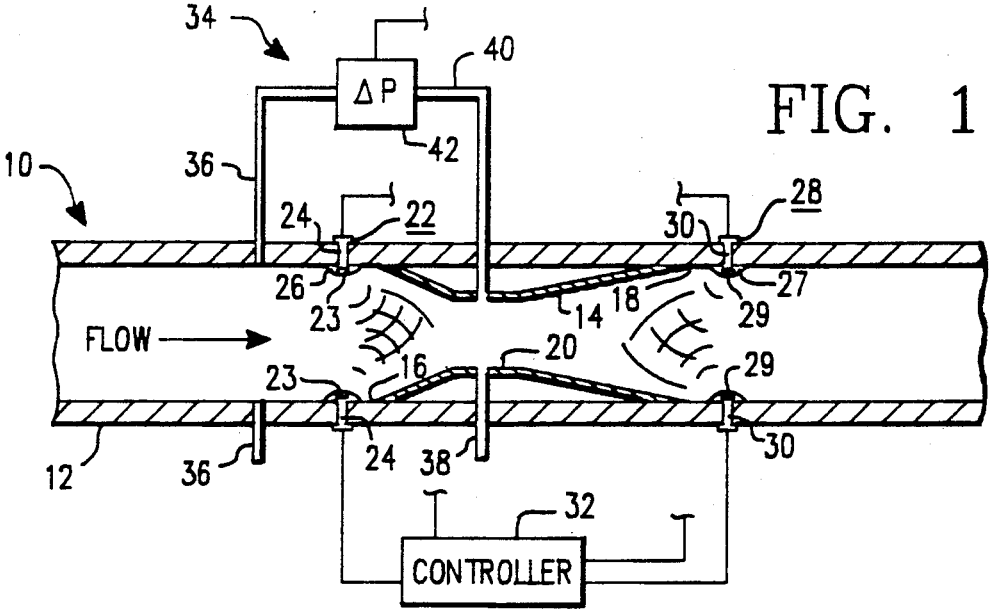
FIG. 1 is a schematic, cross-sectional view of a first preferred embodiment of the present invention.

Referring first to FIG. 1, an ultrasonic cleaning apparatus is generally referred to by the numeral 10. A pipe 12 is provided with a venturi flow nozzle 14 which includes an inlet 16, an outlet 18 and a venturi throat 20.

First ultrasonic transducer means 22 are mounted in the pipe 12 for transmitting ultrasonic waves directly into and thereby exciting the fluid flowing through the venturi flow nozzle 14. A plurality of first openings are formed in the pipe 12 at equidistantly spaced intervals radially around the pipe 12 in spaced proximity to and upstream of the inlet 16 of the venturi flow nozzle 14. A plurality of first housings 24 are correspondingly fitted into the first openings. Each first housing 24 includes a head portion 26 which is in communication with the fluid flowing through the pipe 12.

The first ultrasonic transducer means includes a plurality of first transducers 23 mounted in the head portion 26 of a corresponding first housing 24. The head portion 26 has a streamline shape so as not to interfere with fluid flowing through the venturi flow nozzle 14. The ultrasonic transducers 23 are oriented such that the sound waves they produce are aimed or focused downstream towards the inlet 16 and venturi throat 20 of the venturi flow nozzle 14. The streamlined first housings 24 minimize disruption of the flow and prevent perturbation of the nozzle calibration.

Optionally, and especially for venturi applications, a second ultrasonic transducer means 28 may be provided at the outlet 18 of the venturi flow nozzle 14. The second ultrasonic transducer means 28 includes a plurality of second transducers 29 similarly disposed as the first transducers 23 in head portions 27 of second housings 30 which are fitted in second openings provided at equidistantly spaced intervals radially around the pipe 12 at a position downstream of the outlet 18 of the venturi flow nozzle 14. The second transducers 29 are preferably aimed or focused upstream towards the outlet 18 and venturi throat 20 of the venturi flow nozzle 14.

A controller 32 is coupled to the first ultrasonic transducer means 22 and the second ultrasonic transducer means 28 for activating the same. The controller 32 may simply be a manually operated switching unit, or preferably, an automatic controller which activates the plurality of first and second transducers at either predetermined fixed time intervals, or at times and durations determined by the calculation of an algorithm based on a monitored operational parameter of a power system (to be described below). With respect to the manually operated control unit, the ultrasonic cleaning apparatus can be switched on to run constantly to maintain a clean venturi flow nozzle.

Also illustrated in FIG. 1 is a monitor 34 associated with the venturi flow nozzle 14 for determining flow. The monitor 34 includes a plurality of high pressure taps 36, a plurality of low pressure taps 38, and piping 40 which connects a pair of high and low pressure taps to a differential-pressure ($\Delta P$) transmitter 42.

The embodiment of FIG. 1 is applicable to new or used nozzles, and in particular, venturi flow nozzles. The apparatus is retrofittable, but not while the power plant which includes the pipe is on-line. It may be necessary to recalibrate the nozzle after installation of the first and second ultrasonic transducer means.

Figure 2:
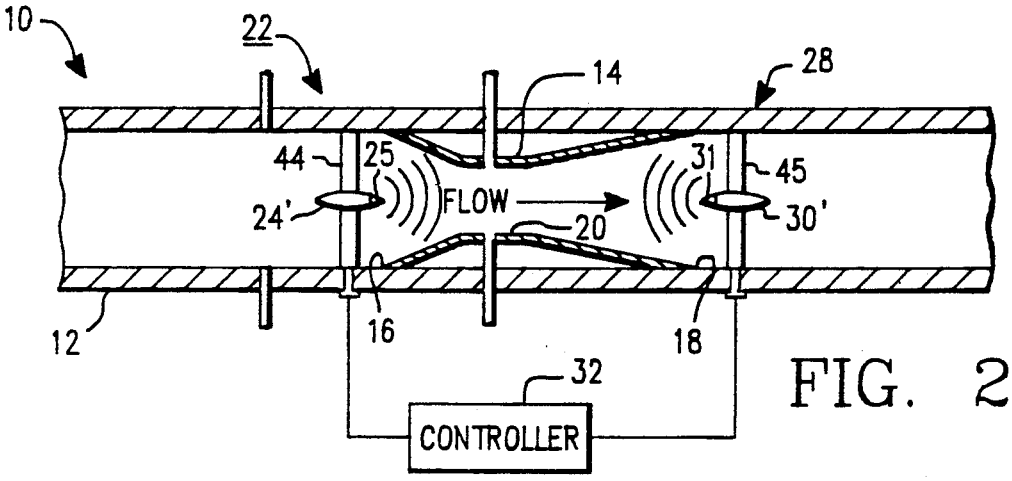
FIG. 2 is a schematic, cross-sectional view of a second preferred embodiment of the present invention.

FIG. 2 illustrates a second embodiment, in which the structure of the pipe 12 and the venturi flow nozzle 14 is the same, except that no opening are formed for the purpose of receiving housings The apparatus also includes first ultrasonic transducer means 22 and second ultrasonic transducer means 28, which are located at about the same positions along the pipe 12 as the first embodiment. However, in the embodiment of FIG. 2, both of the ultrasonic transducer means include a single housing 24' and 30', respectively, each of which is mounted on a strut 44 and 45 disposed centrally in the pipe 12. The first transducer means 22 is a transducer 25 mounted in the downstream end of the housing 24', while the second transducer means 28 is a transducer 31 disposed in the upstream end of the housing 30'. The transducer housings 24' and 30', and the strut(s) 44 and 45 are streamlined to minimize flow, disturbance and to prevent perturbation of the nozzle calibration. Both housings 24' and 30' are disposed centrally in the pipe 12. Both transducers 25 and 31 are aimed or focused towards the venturi throat 20.

The embodiment of FIG. 2 has the advantage of needing only one transducer to achieve cleaning action over the entire nozzle circumference. The second ultrasonic transducer means 28 is optional for venturi applications. However, the embodiment of FIG. 2 is not retrofittable on-line and may require recalibration of the venturi flow nozzle.

Figure 3:
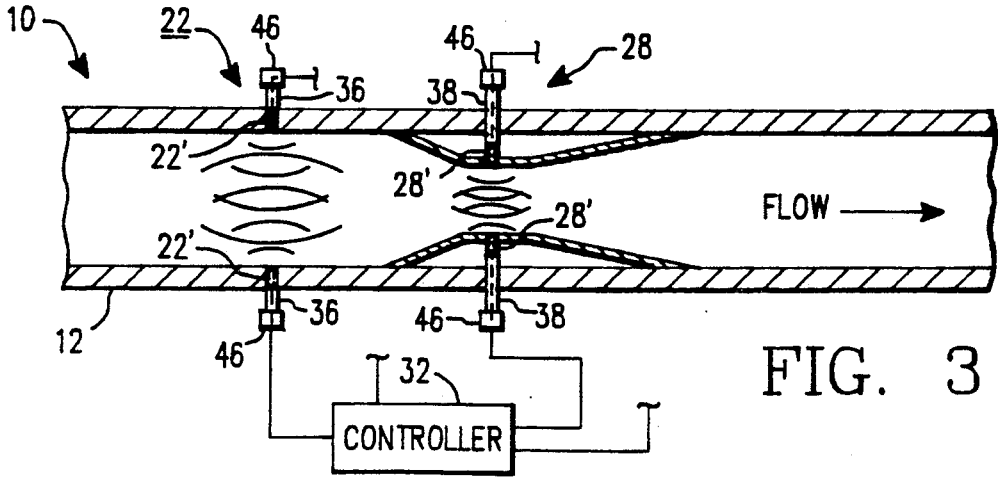
FIG. 3 is a schematic, cross-sectional view of a third preferred embodiment of the present invention.

Referring to FIG. 3, the first ultrasonic transducer means 22 are disposed in the high pressure taps 36 which are not currently in use for pressure sensing. In other words, it is typical for two sets of pressure taps to be monitored to measure the flow rate. The nozzle may be provided with four sets of taps, however, with the two other tap sets reserved as spares. In the embodiment of FIG. 3, an ultrasonic transducer is installed in each spare pressure tap. The transducer may be mounted such that its inner surface is flush with the nozzle throat diameter, or the transducer may be recessed. However, the transducer should not protrude beyond the nozzle pressure tap into the flow. The transducers in the nozzle throat taps would achieve cleaning of the throat area. Ultrasonic transducers may also be installed in the spare nozzle inlet taps in order to clean the nozzle inlet area. This embodiment has the advantage of being more easily retrofittable than the preceding two embodiments, and it eliminates the need to recalibrate the nozzles since nothing disturbs the fluid flow. This embodiment is applicable to new or used nozzles or venturis. It is not applicable to nozzles with only two sets of pressure taps.

Thus, again referring to FIG. 3, the first ultrasonic transducer means 22 includes a plurality of first transducers 22', shown in FIG. 3 to be mounted flush with an inner surface of the pipe 12. The transducers 22' may be fitted directly into the pressure taps 36 or may be provided with housings which are fitted into the pressure taps, such that the transducers 22' are fitted into the housings. A packing gland 46 is provided as a seal over the pressure taps 36. A similar structure is provided for the second ultrasonic transducer means 28, in which a plurality of second transducers 28' are fitted into the low pressure taps 38.

Figure 4:
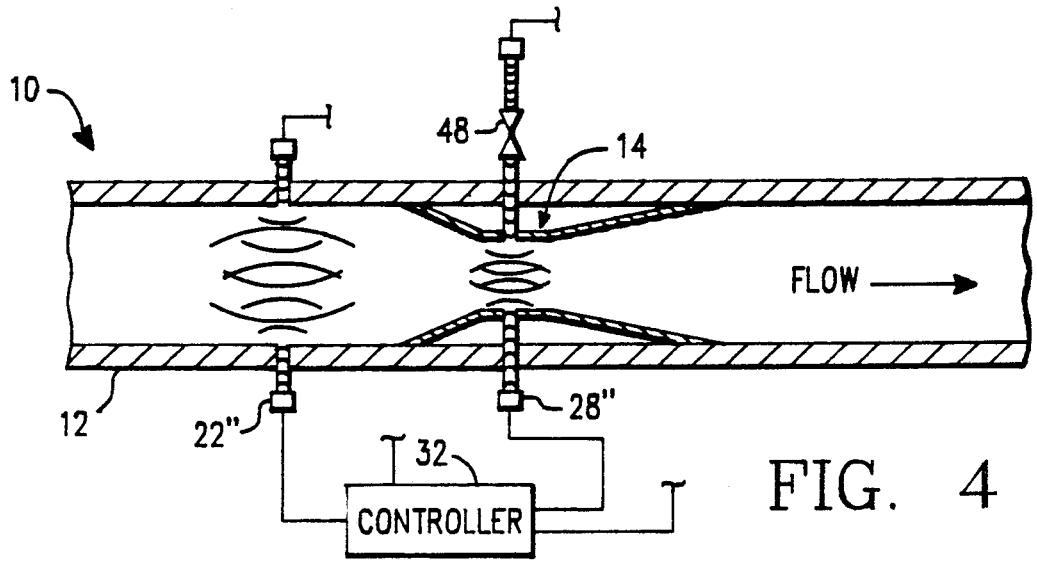
FIG. 4 is a schematic, cross-sectional view of a fourth preferred embodiment of the present invention.

FIG. 4 illustrates a fourth embodiment, which is basically a variation of the third embodiment of FIG. 3. Instead of installing the transducers 22" and 28" inside the venturi flow nozzle, they are installed on the spare pressure taps outside the nozzle, spaced from the pipe and venturi flow nozzle. The sound waves are carried down through the fluid (water) in the spare pressure tap piping and into the area of the venturi flow nozzle 14. The transducers 22" and 28" may be provided with housings which are insertable into the piping for the high and low pressure taps, or they may be directly fitted into or over open ends of the piping. The illustrations are schematic, and thus, the square boxes used to illustrate the transducers represent placement and not details of construction. The details of construction of the transducer do not form a part of the present invention. Suitable transducers or transducer assemblies capable of producing sufficient cleaning action are commercially available and manufactured, for example, by Swen Sonic Corporation. Other suitable transducers can be purchased from other suppliers, although 10 kHz transducers are preferred.

Figure 5:
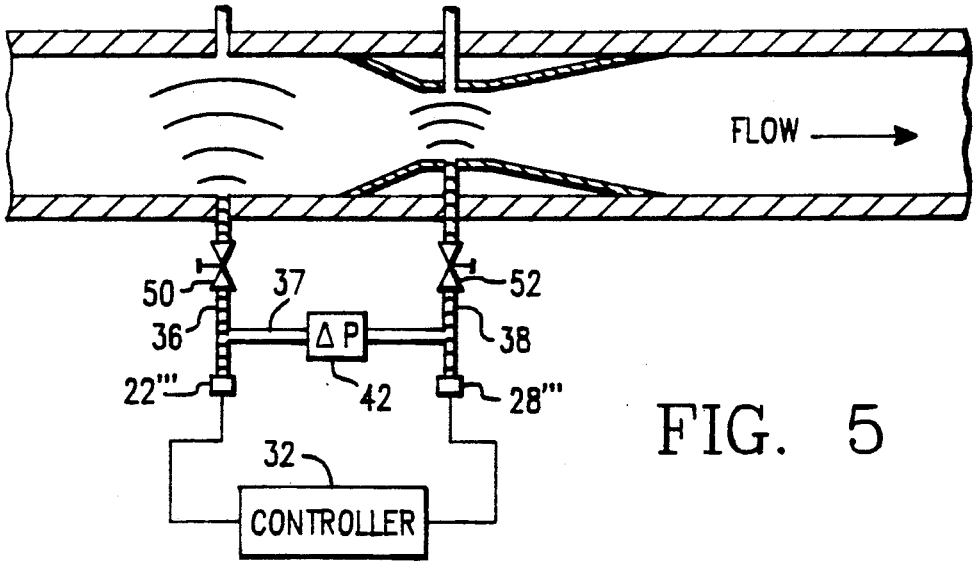
FIG. 5 is a schematic, cross-sectional view of a fifth preferred embodiment of the present invention.

Referring to FIG. 5, a fifth embodiment is illustrated in which a first transducer 22''' is installed in the high pressure tap 36 which is being used actively to measure fluid flow. Similarly, a second transducer 28''' is disposed in the low pressure tap 38. Both transducers 22''' and 28''' are disposed in piping which extends beyond a connector pipe 37 which connects the high pressure tap 36 and the low pressure tap 38 to a $\Delta P$ instrument 42. Similar to the embodiment of FIG. 4, the sound waves are transmitted through fluid in the piping associated with the pair of taps which are used for $\Delta P$ measurement.

In both embodiments of FIGS. 4 and 5, the transducers may be located outside of pressure tap shut-off valves 48, 50, and 52. In order for the ultrasonic waves to pass into the venturi flow nozzle, the valves must be placed in an open position.

FIG. 5 is merely schematic and is not intended to represent the actual construction of the pressure tap piping. This embodiment is retrofittable on-line to all nozzle and venturi types.

The method of ultrasonic cleaning according to the present invention includes the steps of installing ultrasonic transducers in direct contact with the fluid flowing through the pipe at the venturi flow nozzle and activating the ultrasonic transducers to send ultrasonic vibration which causes cavitation in the fluid. The activation of the ultrasonic transducers may be done manually, in which case the controller 32 is simply an on/off switching unit. In the manual embodiment, the transducers may be left to run continuously in order to prevent build up of deposits in the venturi flow nozzle, or remove deposits as they form.

Alternatively, the controller 32 may be provided with a timer mechanism for activating the ultrasonic transducers at predetermined time intervals. The time intervals, and the duration of activation for each interval can be determined empirically on a site-specific basis.

Another aspect of the present invention involves data comparison in order to determine when the ultrasonic transducers should be activated. Thus, an algorithm can be formulated which compares current data to baseline data established when the nozzle was cleaned. Several data items may be used as the basis for the comparison. The controller 32 may thus include a small processor with memory and access to data from a power plant computer or directly from sensors which sense various operational parameters of the power plant.

Pressure may be used as the basis for comparison. The pressure in any stage of a turbine is proportional to the flow passing through the downstream blade row. The pressure must be measured in a location free from errors due to recirculation and must also be insensitive to deviations in other parameters.

Figure 6:
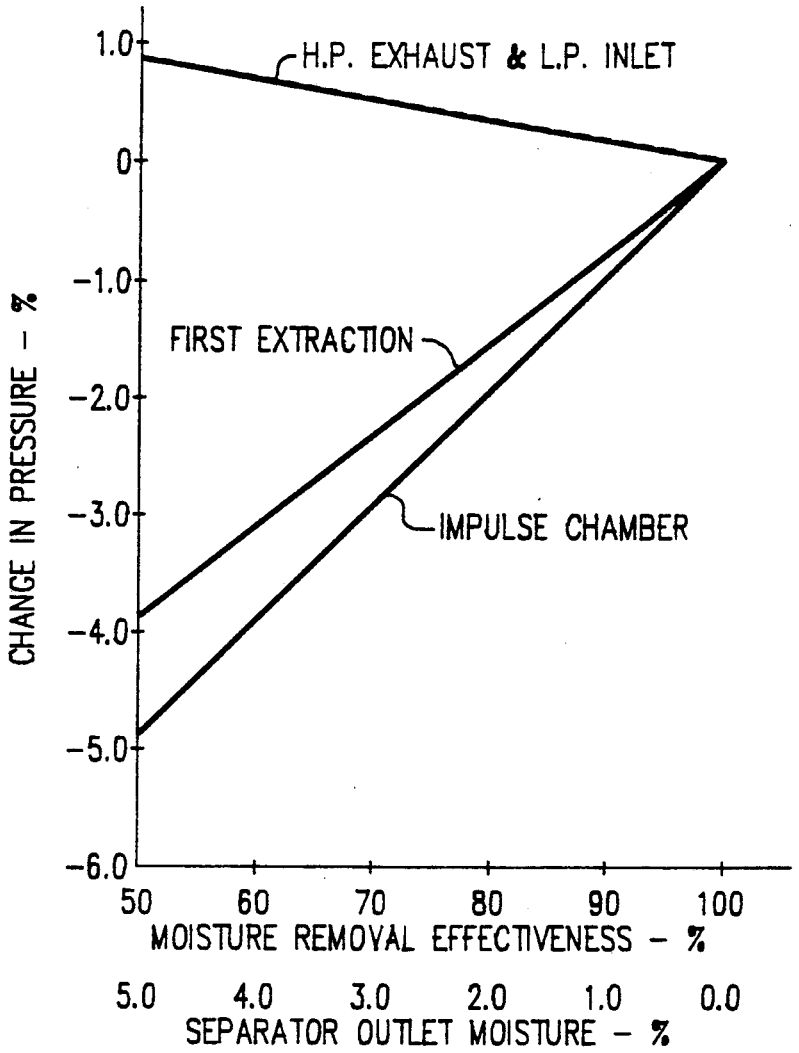
FIG. 6 is a graph showing insensitivity to deviations in moisture removal effectiveness.

For nuclear cycles with moisture separator/reheaters, the low pressure (LP) turbine inlet pressure can be used as such a measurement. FIG. 6 is a graph showing that LP turbine inlet pressure is insensitive to deviations in moisture removal effectiveness. The current LP inlet pressure at the current generator load or thermal power is divided by the stored expected pressure at the same load or power when the nozzles were known to be clean. This ratio would be 1.00 for perfectly clean nozzles and would drop as the nozzles fouled. The ultrasonic cleaning apparatus and method would be activated when the ratio dropped below some reference value and remain on as long as the ratio stayed below that value. A reference ratio of 0.995 is preferable.

The LP inlet pressure must be corrected for deviations in LP inlet temperature in order to properly perform this comparison. In this method, the cleaner would be activated whenever the following equation was true:

$$[(Pc * Tb)/(Pb * Tc)]^{**}0.5 < R$$

where

Pc = Current pressure (psia),
Tb = Absolute baseline temperature (deg R),
Pb = Baseline pressure (psia),
Tc = Absolute current temperature (deg R), and
R = Reference ratio (0.995 suggested).

For non-reheat nuclear units the first stage or impulse chamber pressure may be used. This pressure need not be corrected. The cleaner would then be activated by the following equation:

$$[Pc/Pb] < R$$

Second, the feedwater flow itself could be used for the comparison. The current flow would be divided by the stored expected flow when the nozzle was known to be clean at the same genera&or load or thermal power. The cleaner would be activated by the following equation:

$$[Fc/Fb] < R$$

where

Fc = Current flow (pph), and
Fb = Baseline flow (pph).

As another embodiment, the amplitude response of an ultrasonic receiver(s) mounted in the nozzle is measured and compared to baseline amplitudes. This receiver could be mounted in a pressure tap or in a separately provided opening. The ultrasonic cleaner apparatus would be activated whenever the measured amplitude dropped below a reference value. The receiver(s) would need to be mounted in the throat area of the nozzle, flush with the throat diameter. This is accomplished by mounting the receiver in a similar manner as the transducer described above in the third embodiment of the apparatus and illustrated in FIG. 3.

Figure 7:
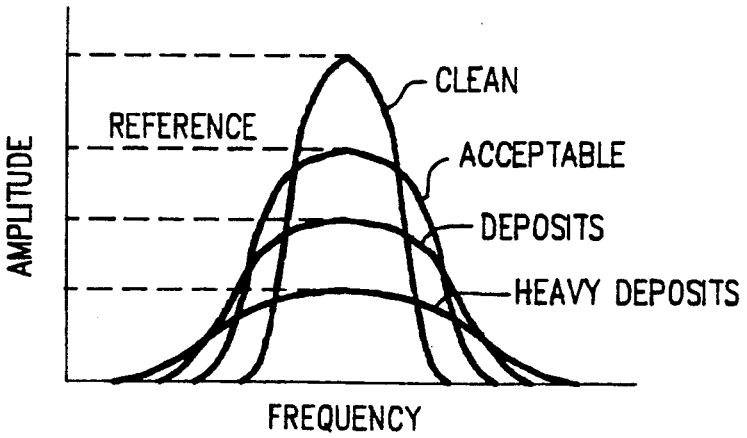
FIG. 7 is a graph of Q or amplitude response of an ultrasonic receiver.

Deposits which plate out on the nozzle will also plate out on the tip of the receiver. The deposits decrease the sound wave amplitude measured by the receiver. The thicker the deposits, the smaller the amplitude. The comparison of fouled and clean amplitude values is done at discrete frequencies in which a reference amplitude corresponds to an acceptable level, below which the cleaner apparatus must be activated. The lower the amplitude, the greater is the need for cleaning. See FIG. 7.

Fouling may like wise be detected by a drop in Q (quality factor) of the transmitting ultrasonic transducer which is induced by fouling within the nozzle and on the transmitter itself.

The aforementioned computations can be performed by the controller 32 which, if necessary, can be provided with a computer for computing the ratios and comparing stored values with monitored values.

Also, the amplitudes and/or Q values can be compared by being processed into digital signals and compared, whereby activation of the ultrasonic transducers is determined by the comparison. The controller 32 can be adapted to include the aforementioned capabilities.

While the invention has been described with respect to venturi flow nozzles, it is also applicable to flow nozzles without a diffuser section, such as a throat tap flow nozzle.

The principles of operation herein can be applied to another embodiment of the invention in which the ultrasonic transmitter is mounted on a retractable probe. One probe is installed near the venturi inlet and another, if necessary, near the outlet. Normally the probe remains recessed in the pipe wall so that the flow is unobstructed. Upon activation, the probe extends the transmitter into the center of the pipe. The probe remains extended for as long as it takes to clean the venturi, and then retracts to its original, recessed position. Probe movement may be accomplished manually with a hand crank, or automatically with a motor which is activated by any of the previously-mentioned control means. This embodiment is not retrofittable on-line and would require an outage to be installed. The probe would alter the venturi calibration when extended, but this could be tolerated if the probe does not need to be activated often and/or if the calibration is only slightly affected.

Numerous alternations and modifications of the structure herein disclosed will suggest themselves to those skilled in the art. It is to be understood, however, that the present disclosure relates to the preferred embodiments of the invention which are for purposes of illustration only and are not to be construed as a limitation of the invention. All such modifications which do not depart from the spirit of the invention are intended to be included within the scope of the appended claims.

What is claimed is:

1. An ultrasonic cleaning apparatus for a venturi flow measuring nozzle mounted in a pipe of a steam power plant and having an inlet, venturi throat, and an outlet, the pipe and nozzle having fluid flowing therethrough, the cleaning occurring while the fluid is flowing, the apparatus comprising:

first ultrasonic transducer means mounted to connect to the inside of the pipe, disposed adjacent the inlet of the venturi flow nozzle and said means being in direct contact with the fluid flowing through the pipe for transmitting ultrasonic waves directly into and thereby exciting the fluid flowing through the venturi flow nozzle; and control means coupled to said first ultrasonic transducer means for activating the first ultrasonic transducer means.

2. An ultrasonic cleaning apparatus as recited in claim 1, further comprising a plurality of first openings formed in the pipe and being equidistantly and radially spaced in proximity to and upstream of the inlet of the venturi flow nozzle, a plurality of first housings fitted in the plurality of first openings, each first housing having a head portion in communication with the fluid flowing through the pipe and being disposed in a corresponding one of the plurality of first openings, the first ultrasonic transducer means comprising a plurality of first transducers, each being mounted in the head portion of a corresponding first housing.

3. An ultrasonic cleaning apparatus as recited in claim 2, wherein each head portion of each first housing extends into an interior of the pipe and has a streamlined shape, and each first transducer is disposed in the head portion of each corresponding first housing and oriented to direct ultrasonic waves towards the inlet of the venturi flow nozzle.

4. An ultrasonic cleaning apparatus as recited in claim 1, further comprising second ultrasonic transducer means, mounted adjacent said venturi flow nozzle outlet downstream of the first ultrasonic transducer means, for transmitting ultrasonic waves directly into and thereby exciting the fluid flowing through the nozzle, and being coupled to the control means.

5. An ultrasonic cleaning apparatus according to claim 4, further comprising a plurality of second openings formed in the pipe and being equidistantly and radially spaced in proximity to and downstream of the outlet of the venturi flow nozzle, a plurality of second housings corresponding to the plurality of second openings, each second housing having a head portion in communication with the fluid flowing through the pipe and being disposed in a corresponding one of the plurality of second openings, and the second ultrasonic transducer means comprises a plurality of second transducers, each being mounted in the head portion of a corresponding housing.

6. An ultrasonic cleaning apparatus as recited in claim 5, wherein each head portion of each second housing extends into the pipe and has a streamlined shape, and each second transducer is disposed in the head portion of each corresponding second housing and oriented to direct ultrasonic waves towards the outlet of the venturi flow nozzle.

7. An ultrasonic cleaning apparatus as recited in claim 1, further comprising first strut(s) mounted within the pipe upstream of the inlet of the venturi flow nozzle and extending between diametrically opposite sides of the pipe, and the first ultrasonic transducer means comprises a first streamlined housing having upstream and downstream ends and being mounted on the first strut(s) centrally in the pipe and a first transducer mounted in the downstream end of the first streamlined housing and being oriented to direct ultrasonic waves towards the inlet of the venturi flow nozzle.

8. An ultrasonic cleaning apparatus as recited in claim 7, further comprising second strut(s) mounted within the pipe downstream of the outlet of the venturi flow nozzle and extending between diametrically opposite sides of the pipe, and second ultrasonic transducer means, coupled to the control means, and including a second streamlined housing having upstream and downstream ends and being mounted on the second strut(s) centrally in the pipe and a second transducer mounted in the upstream end of the second streamlined housing and being oriented to direct ultrasonic waves towards the outlet of the venturi flow nozzle.

9. An ultrasonic cleaning apparatus as recited in claim 1, further comprising a plurality of high pressure taps in fluid communication with the pipe and being located upstream of the inlet of the venturi flow nozzle and a plurality of low pressure taps in fluid communication with the pipe and being located in the venturi throat of the venturi flow nozzle, one of said high pressure taps and one of said low pressure taps being coupled to an instrument for detecting change in pressure, and the first ultrasonic transducer means comprising a plurality of first transducers disposed in the high pressure taps not being coupled to the instrument, for transmitting ultrasonic waves directly into and thereby exciting the fluid flowing through the nozzle.

10. An ultrasonic cleaning apparatus as recited in claim 9, further comprising second ultrasonic transducer means including a plurality of second transducers mounted in the low pressure taps not being coupled to the instrument, for transmitting ultrasonic waves directly into and thereby exciting the fluid flowing through the nozzle.

11. An ultrasonic cleaning apparatus as recited in claim 10, wherein the first and second transducers are mounted flush with an inner surface of the pipe and an inner surface of the venturi throat, respectively.

12. An ultrasonic cleaning apparatus as recited in claim 10, wherein the first and second transducers are mounted in the high pressure taps and low pressure taps, respectively, at positions spaced from the pipe and the venturi throat, respectively, ultrasonic waves being carried through fluid in the high and low pressure taps to the fluid flowing through the pipe at the venturi flow nozzle.

13. An ultrasonic cleaning apparatus as recited in claim 1, further comprising at least one high pressure tap disposed upstream of the inlet of the venturi flow nozzle and at least one low pressure tap disposed in the venturi throat of the venturi flow nozzle and being coupled to the high pressure tap through an instrument, the first transducer means comprising a first ultrasonic transducer mounted in the at least one high pressure tap spaced from the pipe.

14. An ultrasonic cleaning apparatus as recited in claim 13, further comprising second ultrasonic transducer means mounted in the at least one low pressure tap spaced from the venturi throat, the second ultrasonic transducer means comprising a second ultrasonic transducer.

15. An ultrasonic cleaning apparatus as recited in claim 1, further comprising ultrasonic receiver means disposed in the venturi flow nozzle for receiving ultrasonic waves generated by the first ultrasonic transducer means, the control means including means for measuring an amplitude for ultrasonic waves received by the ultrasonic receiver, means for comparing the measured amplitude to a baseline amplitude which is predetermined by testing a fully clean venturi flow nozzle, and means for activating the ultrasonic transducers for so long as the measured amplitude is less than the baseline amplitude.

16. An ultrasonic cleaning apparatus as recited in claim 1, further comprising ultrasonic receiver means disposed in the venturi flow nozzle for receiving ultrasonic waves generated by the first ultrasonic transducer means, the control means including means for measuring Q of the ultrasonic waves received by the ultrasonic receiver, means for comparing the measured Q to a baseline Q which is predetermined by testing a fully clean venturi flow nozzle, and means for activating the ultrasonic transducers for so long as the measured Q is less than the baseline Q.

* * * * *